United States Patent [19]

Turchi

[11] 4,334,475

[45] Jun. 15, 1982

[54] PROXIMITY FUSES

[75] Inventor: Enrico Turchi, Milan, Italy

[73] Assignee: Fratelli Borletti S.p.A., Milan, Italy

[21] Appl. No.: 119,443

[22] Filed: Feb. 7, 1980

[51] Int. Cl.[3] ..... F42C 15/40

[52] U.S. Cl. ..... 102/206; 102/233; 102/264

[58] Field of Search ..... 102/233, 232, 231, 235, 102/211, 206, 262, 264

[56] References Cited

U.S. PATENT DOCUMENTS

| | | | |
|---|---|---|---|
| 2,446,545 | 8/1948 | McCaslin | 102/233 |
| 2,975,711 | 3/1961 | Brown et al. | 102/233 |
| 4,145,971 | 3/1979 | Graham et al. | 102/232 |

*Primary Examiner*—Charles T. Jordan

*Attorney, Agent, or Firm*—Kane, Dalsimer, Kane, Sullivan & Kurucz

[57] ABSTRACT

A fuse provided with a detonator which is ignited by an electrical ignition signal is described. The detonator has a first terminal normally connected to earth and supported by a rotatable member which can move the detonator from a first position in which it is unable to transmit ignition to the chain, to a second position in which a second terminal thereof is in contact with a contact element at which the ignition signal arrives. The rotatable member is rotated by the centrifugal and inertia forces acting on the fuse and is controlled by a delay device arranged to allow it to rotate in a predetermined time and during at least part of the rotation of the rotatable member, the second terminal of the detonator is maintained in electrical contact with the earth so as to make the detonator electrically inactive during the part of the rotation.

5 Claims, 3 Drawing Figures

PROXIMITY FUSES

BACKGROUND OF THE INVENTION

This invention relates to a fuse of the proximity-operating type, provided with a detonator the ignition of which is controlled by an electrical signal.

Fuses of this type normally comprise a proximity sensor device sensitive to electromagnetic waves which is able to emit an ignition signal for the detonator when the projectile on which the fuse is mounted is located at a predetermined distance from the target. Activation means, comprising for example an electronic switch, is normally disposed between the sensor device and the detonator, and is arranged to either make or break electrical connection between the sensor device and the detonator. This depends upon the presence or absence of an electrical activation signal emitted by a timer device which is arranged to emit the signal a predetermined time after launching the projectile. By controlling the activation means, trajectory safety is therefore attained such that any undesirable ignition of the detonator during the first portion of the trajectory, of any required length, is prevented. This length obviously depends on the time (or "lag") between the moment of launching and the moment of emission of the activation signal and this time can be set by adjusting the timer device.

In the fuses of the described type, in addition to the said electronic safety system, there are other systems of mechanical type, the purpose of which is to provide safety while the projectile traverses the firing mouth, or during an initial part of the trajectory. To obtain this further safety, the detonator is mounted on a rotatable member which can move it from a first position in which it is substantially non-aligned with the first element of the pyrotechnic chain and is therefore unable to transmit ignition to the chain, to a second position in which it is aligned with said first element and in which a terminal thereof is brought into contact with a contact element at which said ignition signal arrives. Said rotatable member is rotated by the centrifugal and inertia forces acting on the fuse, and is controlled by a delay device arranged to rotate the member in a predetermined "trajectory" time.

This second safety system therefore acts substantially in a mechanical manner, by retaining the detonator for a predetermined period of time in a position in which even if it were to become ignited, would not cause ignition of the pyrotechnic chain.

SUMMARY OF THE INVENTION

The object of the present invention is to further improve the described "trajectory" safety in such a manner as to also prevent any possible said ignition of the detonator.

The present invention provides a fuse comprising a detonator, which is ignited by an electrical ignition signal. The detonator has a first terminal normally connected to earth and is supported by a rotatable member which can move the detonator from a first position in which it is substantially non-aligned with the first element of the pyrotechnic chain, and is therefore unable to transmit ignition to the chain, to a second position in which it is aligned with the first element and in which a second terminal thereof is in contact with a contact element at which the ignition signal arrives. The rotatable member is rotated by the centrifugal and inertia forces acting on the fuse and is controlled by a delay device arranged to allow the member to rotate in a predetermined time, wherein during at least part of the rotation of the rotatable member, the said second terminal of the detonator is maintained in electrical contact with the earth so as to make the detonator electrically inactive during said part of the rotation.

BRIEF DESCRIPTION OF THE DRAWINGS

The present invention will be more apparent from the description given hereinafter of one embodiment thereof, with reference to the accompanying drawings in which.

DETAILED DESCRIPTION OF THE INVENTION

The improvement of the present invention is applicable to a fuse of the proximity-operation type, i.e. in which the signal for igniting the detonator is given by a proximity sensor device sensitive to electromagnetic waves, of known type, when the projectile on which the fuse is mounted is at a predetermined distance from the target.

Figure 1:
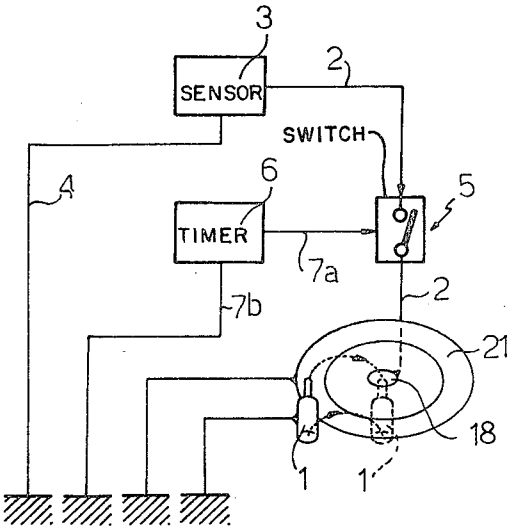
FIG. 1 is a block diagram of the basic electrical circuits of a fuse constructed in accordance with the present invention.

With reference to FIG. 1, which shows a block diagram of the electrical circuits of a fuse of the described type, the detonator, indicated overall by 1, can receive an electrical ignition signal from a proximity sensor device 3 by way of a conductor 2. A point in the circuit of the device is connected to earth through conductor 4. This device is able to generate an ignition signal, in known manner, when the projectile on which the fuse is mounted reaches a predetermined distance from the target.

Between the device and detonator there is disposed an activation means, indicated overall by 5 and diagrammatically as a switch, which enables the ignition signal emitted by the sensor device 3 to reach the detonator 1 when said means are operated by a timer device or circuit, indicated overall by 6, arranged to emit an activation signal through conductor 7*a*. The timer comprise substantially a pulse generator and a pulse counter (not shown) which are connected together in such a manner as to generate the activation signal after a predetermined time from the moment of launching. This time can be set by adjusting the timer circuit. Conveniently, a suitable point in the timer circuit 6 is also connected to earth via a conductor 7*b*.

Figure 2:
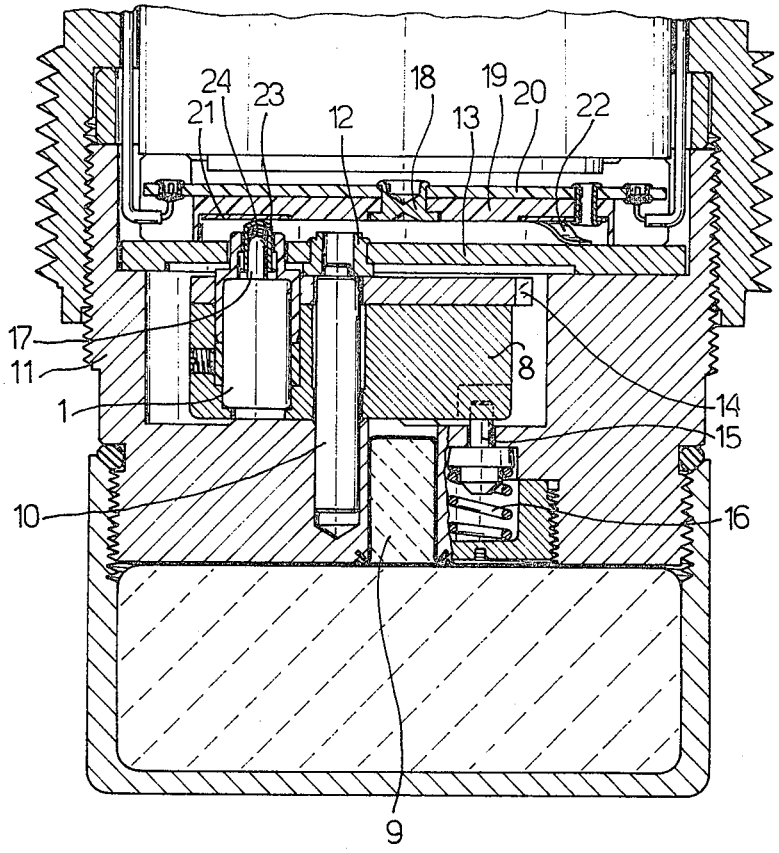
FIG. 2 is a section through part of a fuse according to the invention.

A fuse in which the circuits of FIG. 1 are inserted is shown in FIG. 2. The circuits may be housed in any position inside the fuse, and conveniently in its upper part, not shown.

In a fuse of the described type, the detonator 1 is mounted on a rotatable member 8 which can move the detonator from a first position in which it is substantially non-aligned with a first element 9 of the pyrotechnic chain of the detonator (and is therefore unable to transmit ignition to the chain), to a second position in which it is aligned with said element. For this purpose, the rotatable member 8 is supported by a pin 10, one end of which is rigid with the fuse casing 11, while the other end of said pin is conveniently supported by bushing 12 in a plate 13 which is fixed in any convenient manner to said casing. The axis of the pin 10 has a certain eccentricity to the axis of the fuse, as is clearly shown in FIG. 2, and the axis of the detonator 1 is disposed in the member 8 at a certain radial distance from the pin. The eccentricity and distance are chosen in such a manner that as the result of a predetermined rotation of the rotatable member 8, the axis of the detonator 1 is moved so that it substantially coincides with the axis of the fuse. The member 8, which is of metal, is configured in such a manner that in the first of the two said positions, shown in FIG. 2, its centre of gravity is in such a position as to cause the rotatable member to rotate about the pin 10 under the effect of the centrifugal force (due to the rotation of the fuse about its longitudinal axis), so as to bring the axis of the detonator 1 substantially to coincide with the axis of the fuse. The rotation of the rotatable member 8 is controlled by a delay device (not shown) which allows the member to rotate from the first to said second position in a predetermined time. Said device, of known type, comprises substantially some pairs of gear wheels which are driven by a toothed sector 14 rigid with the rotatable member 8 and transmit their motion to suitable escapement members.

Suitable safety devices enable the rotatable member 8 to rotate only when the force of inertia acting on it reaches a required predetermined value, such as that deriving from the launching of a projectile. These devices can comprise a pin 15 loaded by a spring 16 and arranged for insertion into a corresponding cavity in the member 8, or suitable locking members (not shown) which become inserted into radial cavities in said member.

According to the invention, one terminal of the detonator 1, for example the housing 1, is earthed by connecting it electrically to the rotatable member 8 in addition to mechanically. The other terminal of the detonator, constituted for example by a push pin 17, is arranged to receive the ignition signal when the detonator is moved into the second of said two positions, following the rotation of the rotatable member 8. In this position, the push pin 17 comes into contact with a contact element 18 (FIGS. 1 and 2) connected to the conductor 2 as shown in the diagram of FIG. 1. Conveniently, the contact element 18 is supported by a support element 19 constructed of a suitable insulating material, for example plastics, and on which a plate 20 rests. Parts of the circuits of FIG. 1 can be conveniently formed on this plate by printed circuit methods if so desired.

Figure 3:
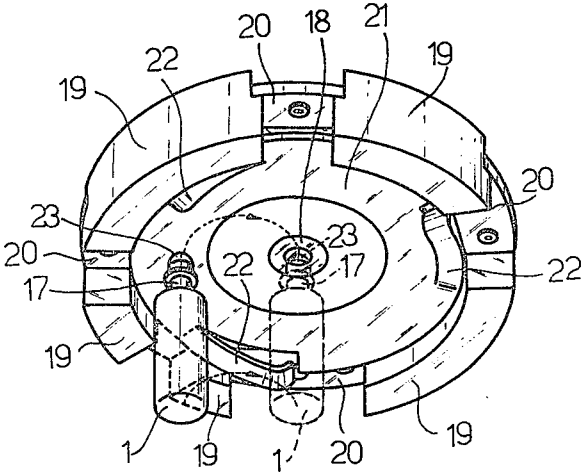
FIG. 3 is a perspective view of certain parts of the safety device in accordance with the improvement of the present invention.

According to the invention, above the detonator 1 and below the support element 19 there is disposed a substantially annular lamina 21 provided with a plurality of resiliently deformable fins 22 arranged to rest with predetermined pressure on the plate 13, in order to make electrical contact therewith. The size and shape of the lamina 21 are chosen such that when the rotatable member 8 is in said first position (that of FIG. 2), the push pin 17 can rest on the lamina. A hollow contact element 23 is conveniently disposed between the push pin and lamina, and is arranged to slide on the lamina against which it is urged by a spiral spring 24. As can be seen clearly from FIG. 3, which shows only certain parts of the device according to the invention, electrical contact between the push pin 17 and lamina 21, and thus the earth connection of the push pin, are maintained during part of the trajectory (indicated by the dashed line) of the rotatable member 8 in moving from the first to the second of said two positions.

The operation of the fuse provided with the improved device of the present invention is as follows.

A predetermined time between the moment of launching and the moment in which said activation signal is generated is set by adjusting the timer device 6 (FIG. 1). On launching the projectile and during the immediately subsequent moments, the high force of inertia acting on the projectile is able to disengage the pin 15 (FIG. 2) and any other locking members for the rotatable member 8, so enabling this to begin its rotation under the effect of the centrifugal force acting on it. During passage through the firing mouth and during the first part of the trajectory, the detonator 1 is put into the condition of not being able to be ignited, even accidentally, as both its terminals are connected to earth. In this respect, both at the moment of launching and during the immediately subsequent moments, i.e. as the contact element 23 (FIGS. 2 and 3) slides along the lamina 21 in moving from the first to the second of said positions, the push pin 17 of the detonator is kept earthed. This connection is broken only when, after leaving the lamina 21, the contact element slides along the support element until it reaches the contact element 18.

It is therefore apparent that the earth connection made by maintaining contact between the lamina 21 and push pin 17 provides a further safety system for the fuse, in addition to the mechanical system due to the non-alignment between the axis of the detonator 1 and the axis of the first element 9 of the pyrotechnic chain. In this manner, as the projectile passes through the firing mouth and through the first part of its trajectory, any undesirable ignition of the detonator 1 is completely prevented.

It is apparent that the time during which the safety provided by the device according to the present invention is operative (and thus the length of the relative trajectory) depend on the form and size of the lamina 21, as can be clearly seen in FIG. 2.

As the course of the projectile continues, at a determined point in its trajectory, the timer device 6 emits the relative activation signal for the activation means 5, which become closed thereby and thus electrically connect the proximity sensor device 3 to the contact element 18.

It is apparent that modifications can be made to the form and arrangement of the various parts of the described embodiment of the present invention, without leaving the scope of the inventive idea.

I claim:

1. A fuse provided with a detonator which is ignited by an electrical ignition signal, said detonator having a first terminal normally connected to earth and being supported by a rotatable member which can move said detonator from a first position in which it is substantially non-aligned with the first element of a pyrotechnic chain, and is therefore unable to transmit ignition to the chain, to a second position in which it is aligned with said first element and in which a second terminal of the detonator is in contact with a contact element at which said ignition signal arrives, said rotatable member being rotated by the centrifugal and inertia forces acting on the fuse and being controlled by a delay device arranged to allow said member to rotate in a predetermined time, wherein during at least part of the rotation of said rotatable member, said second terminal of the detonator is maintained in electrical contact with said earth so as to make said detonator electrically inactive during said part of the rotation.

2. A fuse as claimed in claim 1, wherein a metal lamina connected to earth is disposed above said detonator, said second terminal of the detonator being connected to a sliding element arranged to slide on said lamina during said part of the rotation.

3. A fuse as claimed in claim 2, wherein said metal lamina is of annular shape, is disposed substantially parallel to the plane in which the trajectory of said detonator lies, and is coaxial to said contact element at which the ignition signal arrives, said sliding element comprising a push pin which is axially slidable, by way of a spring, on a part of said detonator.

4. A fuse as claimed in claims 2 or 3, wherein said metal lamina is supported by a support element of insulating material, to which said contact element is also fixed.

5. A fuse as claimed in claim 4, wherein between said rotatable member and said support element of insulating material there is disposed a metal plate arranged to rest on metal parts of the fuse which are connected to earth, said metal lamina being provided with at least one fin arranged to resiliently rest on said metal plate.

* * * * *

UNITED STATES PATENT AND TRADEMARK OFFICE

CERTIFICATE OF CORRECTION

PATENT NO. : 4,334,475

DATED : June 15, 1982

INVENTOR(S) : Enrico Turchi

It is certified that error appears in the above—identified patent and that said Letters Patent is hereby corrected as shown below:

In the Abstract, the last two lines should read -- make the detonator electrically inactive during that part of the rotation--;

Column 2, lines 49 and 50, change "comprise" to --comprises--;

Signed and Sealed this

*Eighth* Day of *February 1983*

[SEAL]

*Attest:*

GERALD J. MOSSINGHOFF

*Attesting Officer*

*Commissioner of Patents and Trademarks*